US008364059B2

(12) United States Patent
Kato

(10) Patent No.: US 8,364,059 B2
(45) Date of Patent: Jan. 29, 2013

(54) IMAGE FORMING DEVICE PROVIDING ACCURATE POSITIONING BETWEEN EXPOSURE UNIT AND PHOTOSENSITIVE BODY

(75) Inventor: Shuichi Kato, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 560 days.

(21) Appl. No.: 12/501,860

(22) Filed: Jul. 13, 2009

(65) Prior Publication Data

US 2010/0021200 A1 Jan. 28, 2010

(30) Foreign Application Priority Data

Jul. 25, 2008 (JP) ..... 2008-192734

(51) Int. Cl.
*G03G 15/00* (2006.01)
*G03G 13/04* (2006.01)
*G03G 21/18* (2006.01)

(52) U.S. Cl. ..... 399/117; 399/32; 399/111; 399/177

(58) Field of Classification Search ..... 399/12, 399/31, 32, 47, 51, 110, 111, 113, 115, 128, 399/177–179, 205, 296
See application file for complete search history.

(56) References Cited

U.S. PATENT DOCUMENTS

| | | | | |
|---|---|---|---|---|
| 5,450,166 | A * | 9/1995 | Yashiro | 399/111 |
| 6,545,693 | B2 * | 4/2003 | Kitayama et al. | 347/138 |
| 2006/0285879 | A1 * | 12/2006 | Yamaguchi et al. | 399/111 |
| 2008/0292359 | A1 * | 11/2008 | Yamaguchi | 399/177 |

FOREIGN PATENT DOCUMENTS

| | | |
|---|---|---|
| JP | 2002-14524 | 1/2002 |
| JP | 2002-311662 | 10/2002 |
| JP | 2005-14497 | 1/2005 |

* cited by examiner

*Primary Examiner* — Walter L Lindsay, Jr.
*Assistant Examiner* — Jessica L Eley
(74) *Attorney, Agent, or Firm* — Scully, Scott, Murphy & Presser, PC

(57) ABSTRACT

An image forming device capable of providing precise positional relationship between an exposure unit and a photosensitive body. The exposure unit having an exposure head elongated in a longitudinal direction and having light emitting sections arrayed in the longitudinal direction. The light elements emit light in an optical axis direction. A frame supports the photosensitive body. A positioning protrusion protrudes in the optical axis direction from one of the frame and the exposure unit. A remaining one of the frame and the exposure unit is formed with a positioning part engageable with the positioning protrusion. A biasing unit provides a biasing force that ensures engagement between the positioning protrusion and the positioning part.

16 Claims, 7 Drawing Sheets

IMAGE FORMING DEVICE PROVIDING ACCURATE POSITIONING BETWEEN EXPOSURE UNIT AND PHOTOSENSITIVE BODY

CROSS REFERENCE TO RELATED APPLICATION

This application claims priority from Japanese Patent Application No. 2008-192734 filed Jul. 25, 2008. The entire content of the priority application is incorporated herein by reference.

TECHNICAL FIELD

The present invention relates to an image forming device, and more particularly, to the device having elongated exposure unit.

BACKGROUND

An image forming device such as a laser printer includes an elongated exposure unit such as an LED head for exposing a photosensitive body to light. According to one conventional image forming device, a pin protrudes from the frame in a direction of an optical path defined by the exposure unit, and the exposure unit is formed with a hole fittingly receiving the pin, thereby defining relative position between the exposure unit and the photosensitive body.

SUMMARY

In order to facilitate exchange of a photosensitive body and a developing unit with a new photosensitive body and a new developing unit, an exposure unit is preferably supported to a top cover that can be opened or closed. With this structure, the exposure unit is movable between a close position close to the photosensitive body and a remote position away from the photosensitive body. In order to realize this construction, a predetermined looseness is required between the pin and the hole. Therefore, such looseness may degrade relative positioning between the photosensitive body and the exposure unit.

It is therefore an object of the present invention to provide an image forming device capable of realizing precise positioning between an exposure unit and a photosensitive body.

This and other objects of the invention will be attained by providing an image forming device including a photosensitive body, an exposure unit, a frame, a positioning protrusion, and a biasing unit. The exposure unit has an exposure member elongated in a longitudinal direction and has light emitting sections arrayed in the longitudinal direction. The light emitting sections emit light in an optical axis direction. The frame supports the photosensitive body. The positioning protrusion protrudes in the optical axis direction from one of the frame and the exposure unit. A remaining one of the frame and the exposure unit is formed with a positioning part engageable with the positioning protrusion. The biasing unit provides a biasing force that ensures engagement between the positioning protrusion and the positioning part.

BRIEF DESCRIPTION OF THE DRAWINGS

In the drawings,

FIG. 7(*b*) is a cross-sectional view of an LED head in the color printer according to the second embodiment;

FIG. 8(*b*) is a cross-sectional view showing positioning recess according to a second modification to the second embodiment; and FIG. 8(*c*) is a cross-sectional view showing positioning recess according to a third modification to the second embodiment.

DETAILED DESCRIPTION

Figure 1:
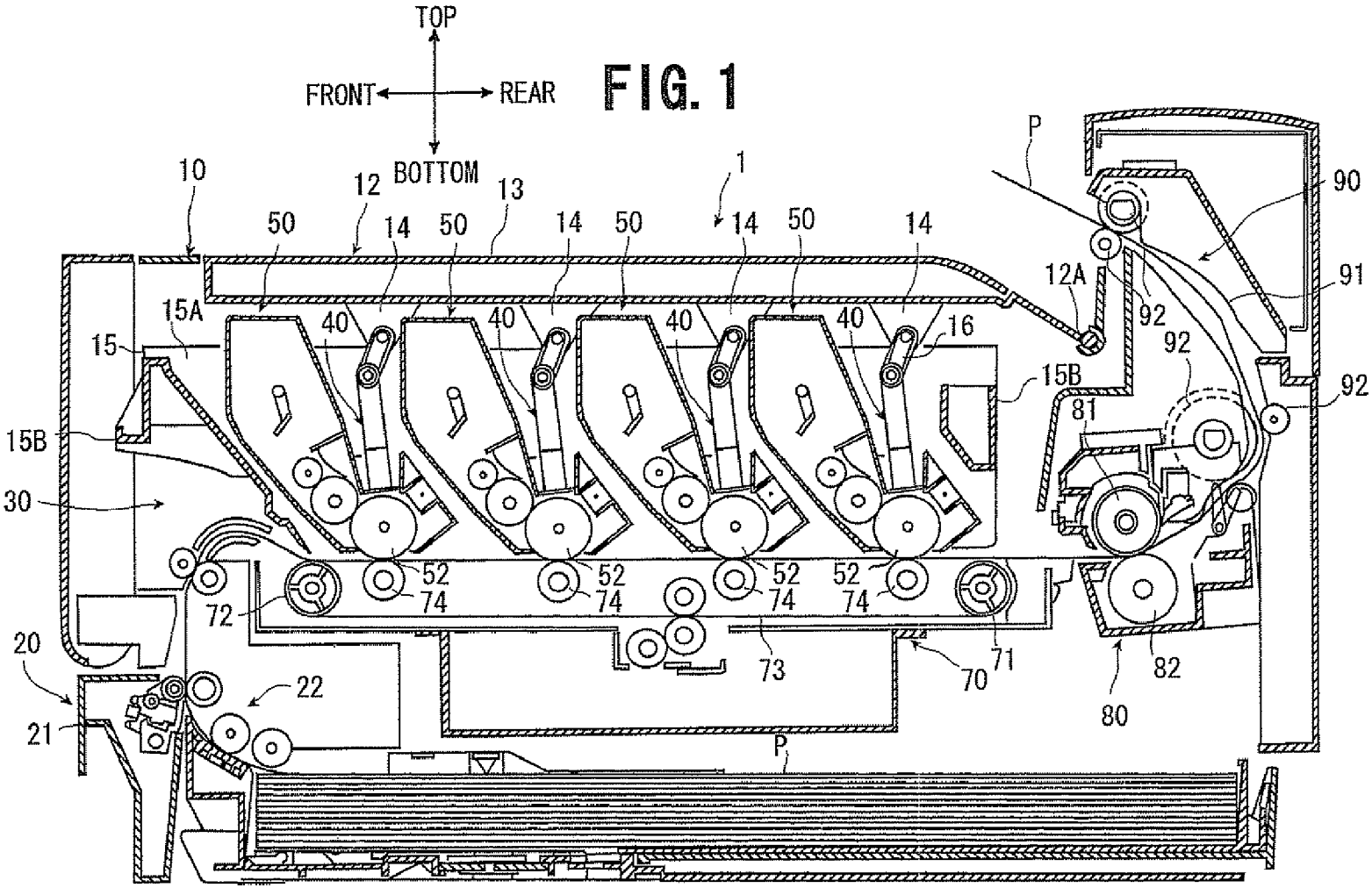
FIG. 1 is a schematic vertical cross-sectional view of an electrophotographic type color printer as an example of an image forming device according to a first embodiment of the present invention.

An image forming device according to a first embodiment of the present invention will be described with reference to FIGS. 1 through 5. The first embodiment pertains to a color printer. The terms "upward", "downward", "upper", "lower", "above", "below", "beneath", "right", "left", "front", "rear" and the like will be used throughout the description assuming that the color printer is disposed in an orientation in which it is intended to be used.

The color printer 1 has an outer frame 10 in which a sheet supply section 20 for supplying a sheet P, an image forming section 30 for forming an image on the sheet P and a sheet discharge section 90 for discharging the sheet bearing the image are provided.

The outer frame 10 has a top opening, and a top cover 12 is provided at an upper portion of the outer frame 10. The top cover 12 has a rear end portion pivotally movably connected to the frame 10 through a pivot shaft 12A, so that the top cover is pivotally moved upward and downward about an axis of the pivot shaft 12A for opening and closing the top opening. The top cover 12 has an upper surface formed with a discharge tray 13 for receiving printed sheets discharged out of the outer frame 10 and has a lower surface provided with a plurality of brackets 14 for supporting LED units 40.

A support frame 15 is disposed in the outer frame 10 and fixed thereto for detachably supporting each process cartridge 50. The support frame 15 includes a pair of side frames 15A and a pair of cross members 15B positioned at front and rear sides of the side frames 15A for connecting the pair of side frames 15A.

The sheet supply section 20 is provided at a lower portion of the outer frame 10, and includes a sheet supply tray 21 and a sheet supply mechanism 22. The sheet supply tray 21 is detachably installed in the outer frame 10 for accommodating therein a stack of cut sheets P. The sheet supply mechanism 22 is adapted for separating an uppermost sheet from the remaining sheet stack and for supplying the separated sheet P from the sheet supply tray 21 to the image forming section 30 positioned above the sheet supply section 20.

Figure 2:
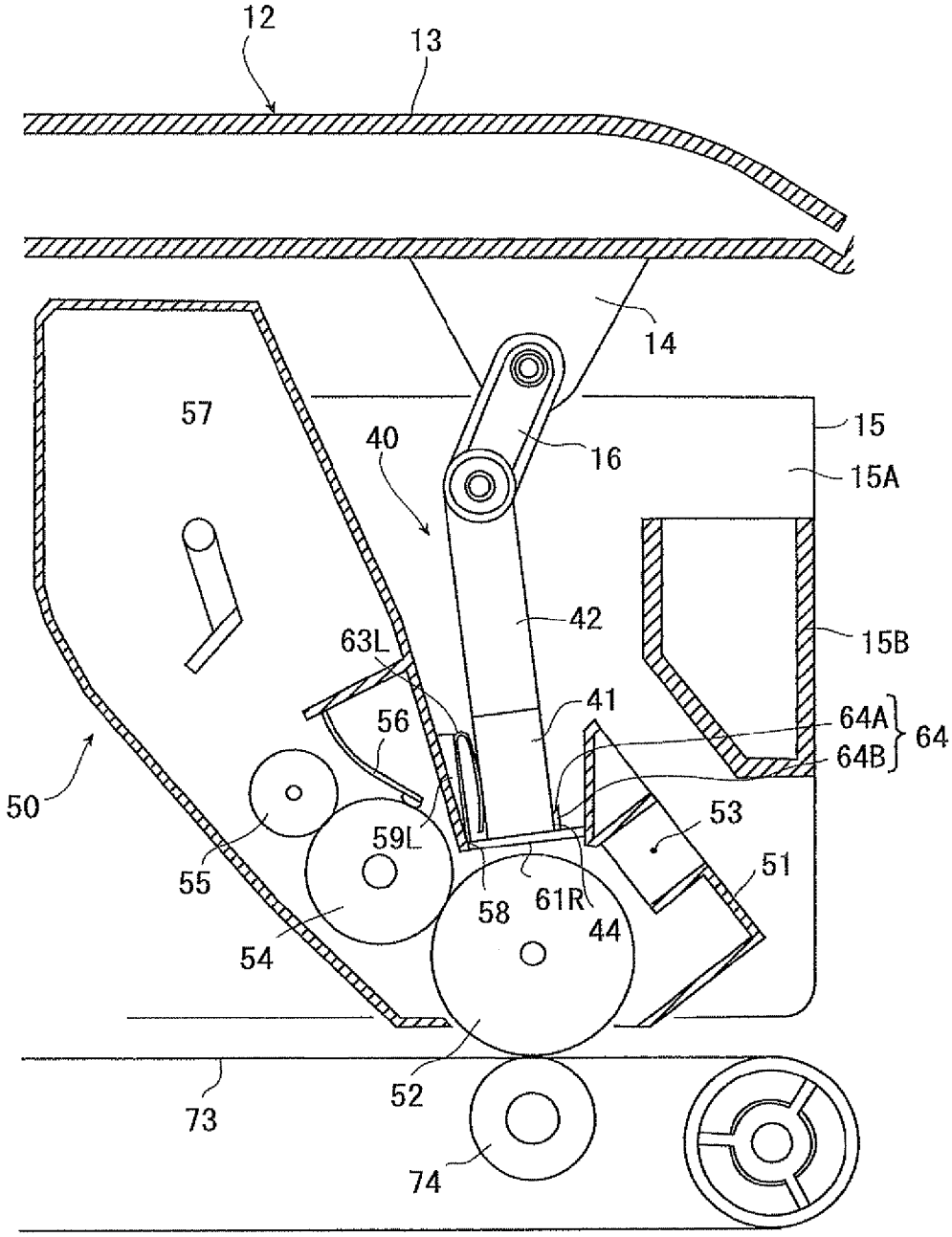
FIG. 2 is an enlarged schematic view of a LED unit and a process cartridge in the color printer according to the first embodiment.

The image forming section 30 includes four LED units 40, four process cartridges 50 as photosensitive units, a transfer unit 70, and a fixing unit 80. As shown in FIG. 2, the LED unit 40 is positioned immediately above a photosensitive drum 52, and includes an LED head 41 and a suspension frame 42 movably supporting the LED head 41. The LED head 41 is an elongated unit extending in a lateral direction (widthwise direction of the sheet P) in which light emitting elements (light emitting sections) such as LEDs are arrayed in the lateral direction. A link 16 has one end portion pivotally movably connected to each bracket 14, and another end portion pivotally movably connected to one end portion of the suspension frame 42 for positioning the LED head 41 relative to the photosensitive drum 52.

The plurality of process cartridges 50 are arrayed in frontward/rearward direction at a position between the top cover 12 and the sheet supply unit 20. Each process cartridge 50 includes a cartridge frame 51, the photosensitive drum 52 rotatably supported to and disposed in the cartridge frame 51, a charger 53, a developing roller 54, a toner supply roller 55, and a blade 56. A toner container portion 57 is defined in the cartridge frame 51.

Each process cartridge 50 is accessible through the top opening of the outer frame 10 when the top cover 12 is open. The process cartridge 50 is detachably attached to the support frame 15. All process cartridges 50 are identical to one another except the kind of developer agent (toner) contained in the toner container portion 57.

The transfer unit 70 is disposed between the sheet supply section 20 and the process cartridges 50, and includes a drive roller 71, a driven roller 72, an endless conveyer belt 73, and four transfer rollers 74.

The drive roller 71 and the driven roller 72 extend parallel to each other and are positioned spaced away from each other in the frontward/rearward direction. The endless conveyer belt 73 is mounted over the drive roller 71 and the driven roller 72 under tension. The conveyer belt 73 has an outer peripheral surface with which each photosensitive drum 52 is in contact, and has an inner peripheral surface with which four transfer rollers 74 are in contact. Each transfer roller 74 is positioned in alignment with each photosensitive drum 52 to nip the conveyer belt 73 therebetween. A transfer bias is applied to each transfer roller 74 for image transfer.

The fixing unit 80 is positioned downstream of the process cartridge 50 and the transfer unit 70 in the sheet feeding direction, and includes a heat roller 81 and a pressure roller 82 in pressure contact with the heat roller 81.

In the image forming section 30, the outer peripheral surface of the photosensitive drum 52 is uniformly charged by the charger 53. Then, the surface is exposed to light by the LED unit 40, whereupon electrostatic latent image based on the image data is formed on the surface of the photosensitive drum 52. The latent image area has a potential lower than that of the remaining portion.

Rotation of the toner supply roller 55 supplies toner in the toner container portion 57 to the developing roller 54. Upon rotation of the developing roller 54, the blade 56 regulates a thickness of a toner layer over the developing roller 54 into a constant thickness. Then, the toner is supplied to the electrostatic latent image region on the photosensitive drum 52 from the developing roller 53. As a result, a visible toner image corresponding to the electrostatic latent image is formed on the surface of the photosensitive drum 52.

Then, the sheet P supplied onto the conveyer belt 73 is moved past each photosensitive drum 52 and each transfer roller 54, whereupon each toner image on each photosensitive drum 52 is transferred onto the sheet P in a superposed relation. Then, the sheet P is moved past the heat roller 81 and the pressure roller 82, so that the toner image is thermally fixed to the sheet P.

The sheet discharge section 90 includes a discharge guide 91 and discharge rollers 92. The discharge guide 91 extends rearward from an exit of the fixing unit 80 and curved frontward. The discharge rollers 92 are positioned along the discharge guide 91 for discharging the sheet P passing through the discharge guide 91 toward the discharge tray 13.

Next, a structure for positioning the LED head 41 with respect to the photosensitive drum 52 will be described, in which direction referred implies the direction as if the process cartridge 50 is assembled to the support frame 15. Further, in the following description, "longitudinal direction" implies a longitudinal direction of the LED head 41, and can be the same as lateral direction or widthwise direction of the sheet P. Further, "direction of optical axis" implies the direction of an optical path extending from the LED head 41, and can be almost the same as vertical direction.

Figure 3:
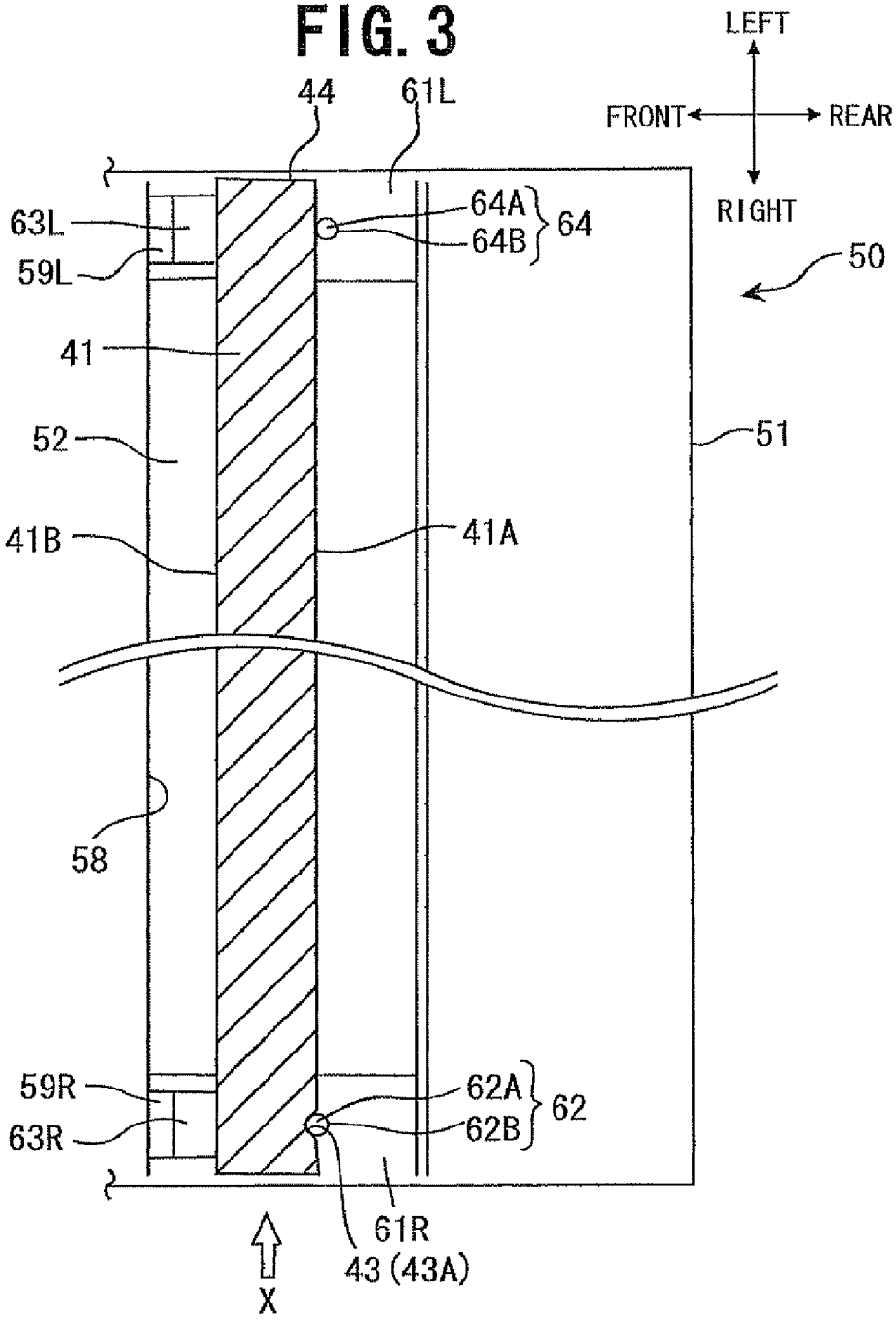
FIG. 3 is a plan view of an LED head of the LED unit and the process cartridge in the color printer according to the first embodiment.
Figure 4:
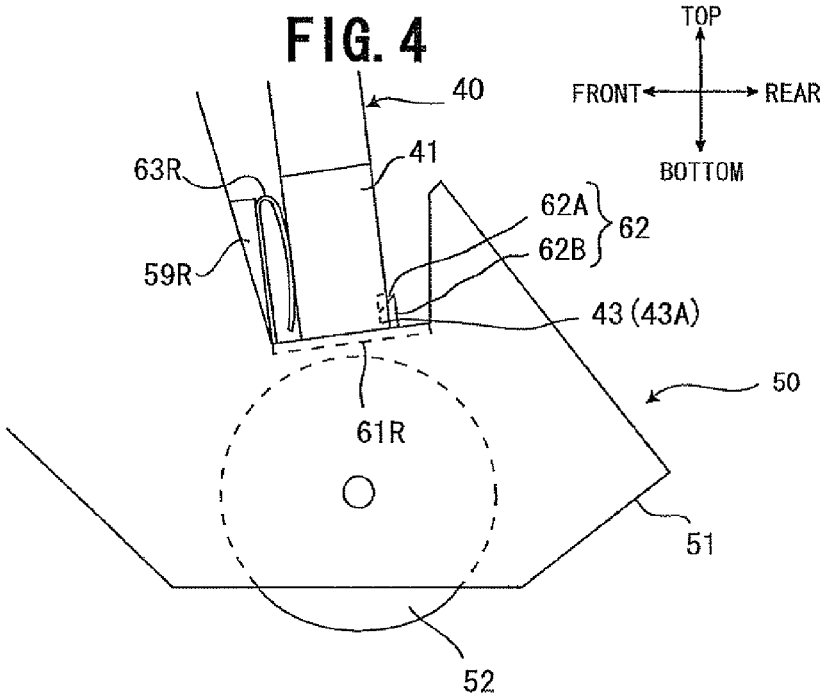
FIG. 4 is a partial side view of the LED head and the process cartridge as viewed in a direction indicated by an arrow X in FIG. 3.

As shown in FIG. 3, the cartridge frame 51 has a right base plates 61R and a left base plate 61L positioned immediately above right and left end portions of the photosensitive drum 52 for covering the end portions. As shown in FIGS. 2 and 4, a bottom end of the LED head 41 is in contact with the base plates 61R, 61L. An exposure opening 58 is defined between the base plates 61R and 61L, so that the photosensitive drum 52 is exposed to atmosphere through the exposure opening 58.

As shown in FIGS. 3 and 4, a first positioning protrusion 62 protrudes from an upper surface of the right base plate 61R in the direction of optical axis i.e., generally upward. The positioning protrusion 62 has an upper end face 62A slanting downward toward front, and has a cylindrical surface 62B. A leaf spring 63R is positioned in front of the cylindrical surface 62B, and is attached to a spring seat 59R disposed at a right end portion of the cartridge frame 51.

As shown in FIGS. 2 and 3, a second positioning protrusion 64 protrudes from an upper surface of the left base plate 61L in the direction of the optical axis. The second positioning protrusion 64 has an upper end face 64A slanting downward toward front, and has a cylindrical surface 64B. A leaf spring 63L is positioned in front of the cylindrical surface 64B, and is attached to a spring seat 59L disposed at a left end portion of the cartridge frame 51.

As shown in FIG. 3, the right and left leaf springs 63R, 63L are approximately aligned with each other in the frontward/rearward direction. On the other hand, the first positioning protrusion 62 is positioned slightly frontward of the second positioning protrusion 64.

The LED head 41 has a rear surface 41A whose lower right portion is formed with a positioning recess 43 engageable with the cylindrical surface 62B of the first positioning protrusion 62, and whose lower left portion is formed into a flat abutment surface 44 to which the cylindrical surface 64B of the second positioning protrusion 64 is abuttable.

More specifically, the positioning recess 43 is positioned in alignment with the first positioning protrusion 62, and is configured into V-shaped groove defining an engagement surface 43A with which the cylindrical surface 62B is engageable.

As shown in FIG. 2, the LED head 41 is suspended from the top cover 12 through the suspension frame 42, the link 16 and the bracket 14. Since the top cover 12 is pivotally movable upward and downward about the axis of the pivot shaft 12A, the LED head 41 is movable between a proximity position adjacent to the photosensitive drum 52 as shown in FIG. 2 and a remote position away from the photosensitive drum 52.

Figure 5:
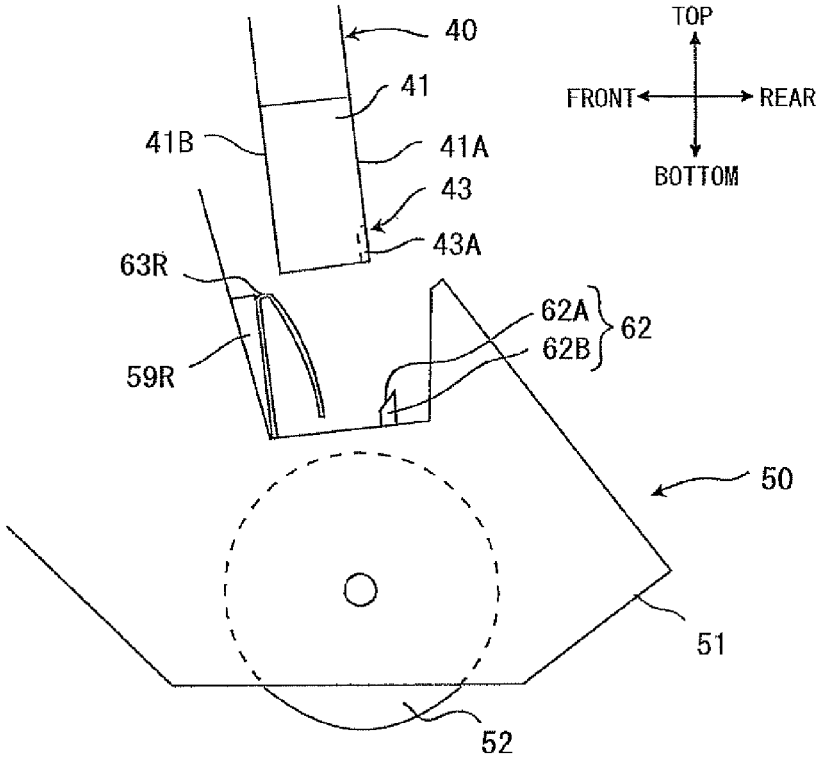
FIG. 5 is a view for description of movement of the LED head from its remote position to a proximity position in the color printer according to the first embodiment.

In accordance with the movement of the top cover 12 from its open position to its close position, the LED head 41 is moved toward the proximity position as shown in FIG. 5. During this movement, a front surface 41B of the LED head 41 is brought into abutment with the leaf springs 63R and 63L. Then, the LED head 41 is further moved downward while depressing the leaf springs 63R, 63L frontward. Then, the positioning recess 43 is brought into engagement with the cylindrical surface 62B of the first positioning protrusion 62, and at the same time, the LED head 41 is engaged with the left leaf spring 63L and the second positioning protrusion 64. Finally, the bottom end face of the LED head 41 is brought into abutment with the upper surfaces of the base plates 61L, 61R, whereupon the LED head 41 is at the proximity position.

Because the leaf springs 63R, 63L urge the front surface 41B of the LED head 41 rearward, the positioning recess 43 and the abutment surface 44 are urged rearward toward the cylindrical surfaces 62B, 64B of the first and second positioning protrusions 62, 64, respectively. Consequently, the position of the LED head 41 can be fixed relative to the cartridge frame 51.

More specifically, frontward/rearward position of the LED head 41, i.e., a position in a direction perpendicular to the longitudinal direction and optical axis direction of the LED head 41 can be determined by the pressure contact between the positioning recess 43 and the first positioning protrusion 62, and between the abutment surface 44 and the second positioning protrusion 64. Further, the position of the LED head 41 in the longitudinal direction can be determined by the engagement between the positioning recess 43 and the first positioning protrusion 62. Thus, the position of the LED head 41 with respect to the photosensitive drum 52 supported in the cartridge frame 51 can be fixed.

With the above-described structure, the relative position between the LED head 41 and the photosensitive drum 52 can be accurately provided by the linearly directed biasing force of the leaf springs 63R, 63L disposed at the cartridge frame 51 toward the LED head 41. Further, the first positioning protrusion 62 is engaged with the V-shaped engagement surface 43A, the first positioning protrusion 62 can be subjected to positioning by two surfaces of V-shaped surface 43A. Thus, accurate positioning can be attained in the lateral direction thereby realizing accurate positioning between the LED head 41 and the photosensitive drum 52, to thus enhance imaging quality.

Further, the LED head 41 is subjected to positioning at two positions laterally spaced from each other by two positioning protrusions 62 and 64 and corresponding positioning recess 43 and abutment surface 44. Thus, any pivotal movement of the LED head 41 in frontward/rearward direction about one of the positioning protrusions does not occur. Thus, positioning between the LED head 41 and the photosensitive drum 52 can be provided at high accuracy.

Further, the cartridge frame 51 is an outer casing of the process cartridge 50, and the leaf springs 63R, 63L are provided at the cartridge frame 51. Therefore, highly accurate position of the LED head 41 relative to the cartridge frame 51 can be obtained thereby ensuring accurate positioning between the LED head 41 and the photosensitive drum 52, to thus enhance imaging quality.

Further, the upper slanting surfaces 62A, 64A of the first and second positioning protrusions 62, 64 can perform as guide surfaces for guiding movement of the LED head 41 toward the proximity position, facilitating movement of the LED head 41 toward the proximity position.

A color printer according to a second embodiment of the present invention will next be described with reference to FIGS. 6 through 7(*b*), wherein like parts and components are designated by the same reference numerals as those shown in FIGS. 1 through 5.

Figure 6:
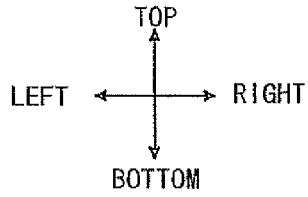
FIG. 6 is a schematic view of a color printer according to a second embodiment of the present invention.
Figure 6:
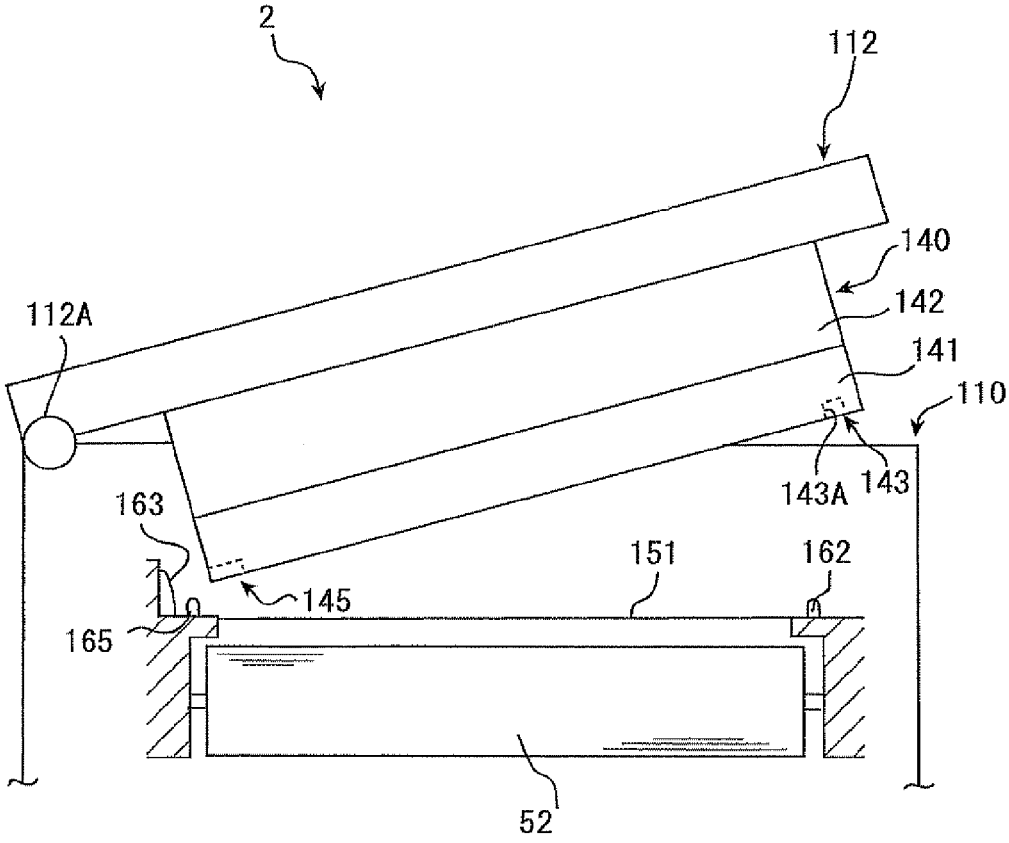
Figure 7A:
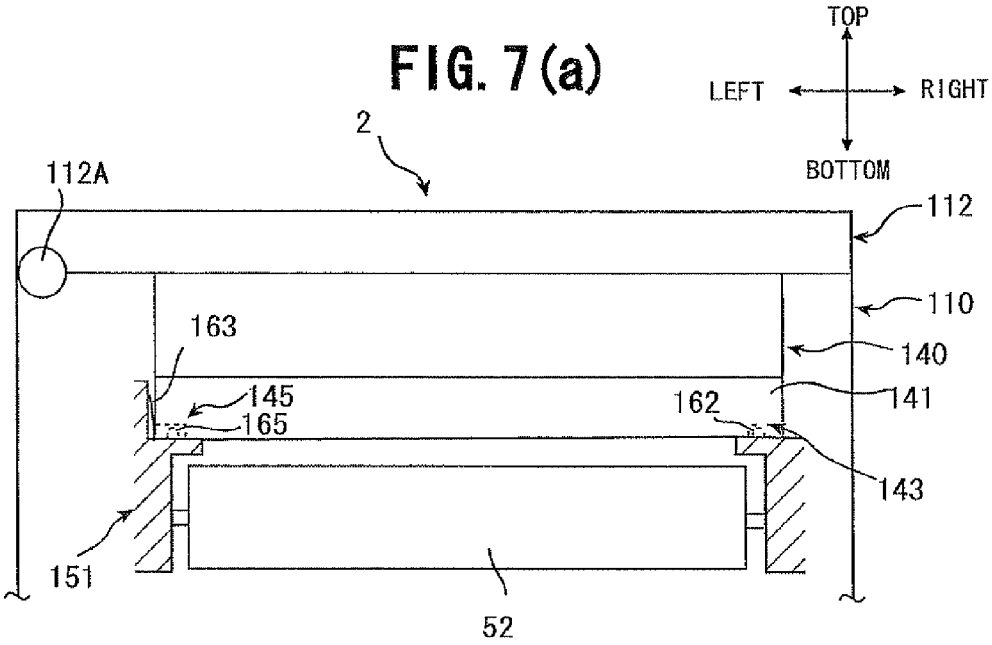
FIG. 7(*a*) is a schematic view of the color printer according to the second embodiment and in a closed state of a top cover.
Figure 7B:
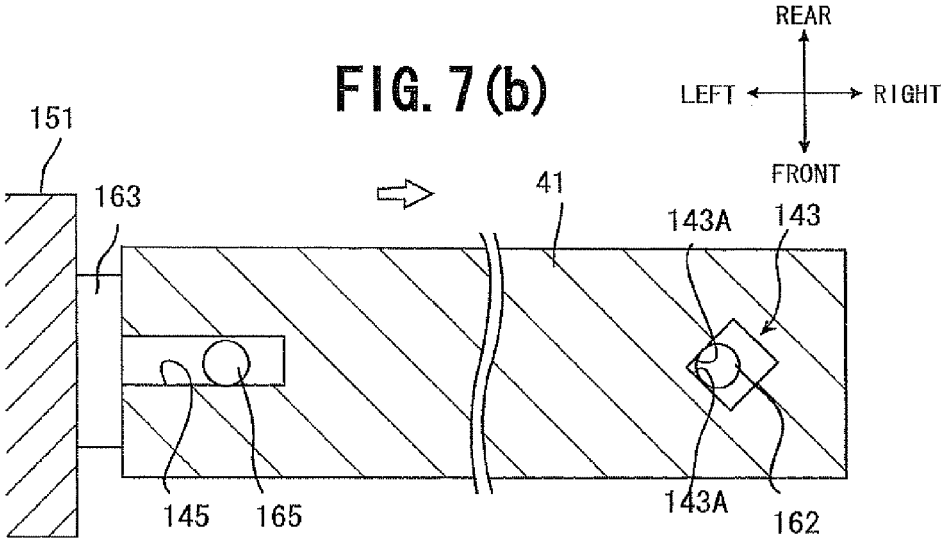

As shown in FIG. 6, the color printer 2 has an outer frame 110 in which a sheet supply section (not shown), an image forming section (not shown) and a sheet discharge section (not shown) are provided. The outer frame 110 has a top opening, and a top cover 112 is provided at an upper portion of the outer frame 110. The top cover 112 has a left end portion pivotally movably connected to the frame 110 through a pivot shaft 112A, so that the top cover is pivotally moved upward and downward about an axis of the pivot shaft 112A for opening and closing the top opening. An LED unit 140 is attached to a bottom surface of the top cover 112, so that the LED unit 140 is movable toward and away from the photosensitive drum 52 in accordance with the pivotal movement of the top cover 112.

The LED unit 140 includes an LED head 141 having a structure the same as that of the above-described LED head 41, and a link member 142 for linking the LED head 141 to the top cover 112. The LED head 141 has a lower right end portion formed with a positioning recess 143 and has a lower left end portion formed with a guide groove 145.

The positioning recess 143 is in the form of a rectangular hole extending upward from the bottom surface of the LED head 41. The hole has a V-shaped side walls (see FIG. 7(*b*)) functioning as an engagement surface 143A engageable with a positioning protrusion 162.

The guide groove 145 extends from the left end of the LED head 141 toward right, and has a rectangular cross-section for engagement with a guide protrusion 165 (described later) when the LED head 141 is moved from its remote position to proximity position so as to guide and regulate movement of the LED head 141. A photosensitive drum 51 is rotatably supported to a cartridge frame 151 disposed within the outer frame 110.

The positioning protrusion 162 and the guide protrusion 165 are provided at the cartridge frame 151 at positions above the photosensitive drum 52 and corresponding to the positioning recess 143 and the guide groove 145, respectively. The positioning protrusion 162 protrudes upward and has a cylindrical shape. A leaf spring 163 is also provided at the cartridge frame 151 at a position leftward of the guide protrusion 165.

In accordance with closing movement of the top cover 112, the LED head 141 moves from its remote position to the proximity position. During this movement, The guide groove 145 of the LED head 141 is brought into engagement with the guide protrusion 165, and the leaf spring 163 is depressed leftward. Then, the engagement surface 143A of the positioning recess 143 is brought into engagement with the positioning protrusion 162, thereby providing the proximity position shown in FIG. 7(*a*).

In this proximity position, since the leaf spring 16 is depressed leftward, the leaf spring 16 biases the LED head 141 rightward. Therefore, as shown in FIG. 7(*b*), the positioning recess 143 is urged toward the cylindrical surface of the positioning protrusion 162, so that the V-shaped engagement surface 143A tightly engages the cylindrical surface. Therefore, as shown in FIG. 7(*b*), the longitodinal position (rightward/leftward position) of the LED head 143 relative to the cartridge frame 151 can be fixed, thereby fixing the longitudinal position of the LED head 141 relative to the photosensitive drum 52.

With this structure, biasing direction by the leaf spring 163 is also the longitudinal direction. Therefore, precise positioning can be attained to enhance imaging quality. Incidentally, in order to improve imaging quality, dimensional tolerance between the guide groove 145 and the guide protrusion 165 should be as small as possible.

Figure 8A:
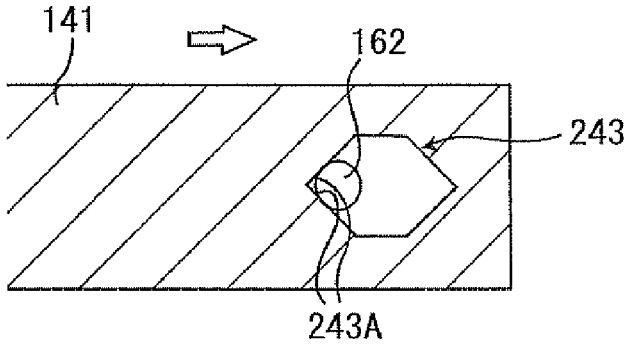
FIG. 8(*a*) is a cross-sectional view showing positioning recess according to a first modification to the second embodiment.
Figure 8B:
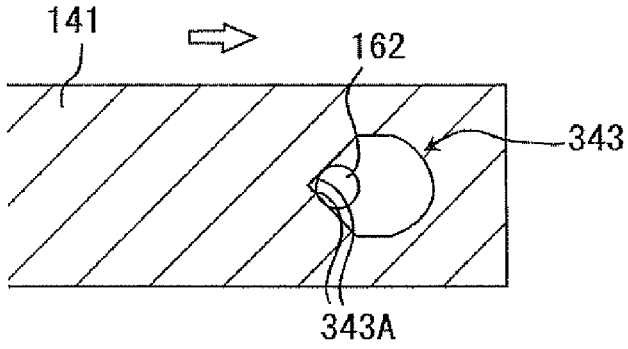
Figure 8C:
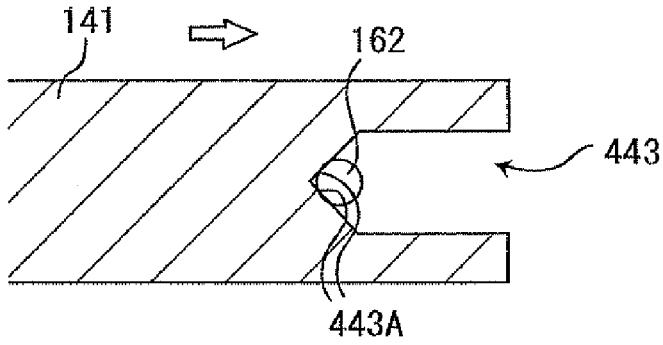

FIGS. 8(*a*) through 8(*c*) show various modifications to the second embodiment in which an arrow is indicative of a direction of a biasing force of the leaf spring 163. According to a first modification shown in FIG. 8(*a*), a hexagonal positioning hole 243 is formed at the LED head 141. According to a second modification shown in FIG. 8(*b*), a sector shaped positioning hole 343 is formed at the LED head 141. According to a third modification shown in FIG. 8(*c*), a U-shaped positioning groove 443 is formed at the LED head 141. In these modifications, V-shaped engagement surfaces 243A, 343A, 443A are provided to engage the cylindrical surface of the positioning protrusion 162.

Various modifications are conceivable. For example, in the foregoing embodiments, the positioning protrusions 62, 64, leaf springs 63R, 63L, positioning protrusions 162, guide protrusion 165, and the leaf spring 163 are provided at the cartridge frame 51, 151. However, these can be provided at the support frame 15 or outer frame 10, 110. Further, instead of the positioning recess 43, a positioning slot or hole for receiving the positioning protrusion is also available.

Further, in the above-described embodiments, the positioning protrusion 62, 162 are provided at the cartridge frame 51, 151, and the positioning recess 43,143 are formed at the LED head 41,141. However, positioning protrusion can be provided at the LED head, and positioning recess can be formed at the cartridge frame or support frame or outer frame.

Further, in the first embodiment, the positioning recess 43 and the abutment surface 44 are formed at the rear surface 41A of the LED head 41. However, these can be formed at the front surface 41B of the LED head 41. In the latter case, positions of positioning protrusions 62, 64 and leaf springs 63R, 63L must be changed correspondingly.

Further, in the first embodiment, the process cartridge 50 having the photosensitive drum 52, developing roller 54, and toner container portion 57 is the example of the photosensitive unit. However, a photosensitive cartridge having a cartridge case, a photosensitive drum and a charger disposed in the cartridge case is also available as the photosensitive unit.

Further, in the above-described embodiments, the photosensitive drum is employed as the photosensitive body. However, a photosensitive belt is also available.

Further, in the above-described embodiments, LED is employed as a light emitting element. However, various exposure is available such as electro-luminescence element and fluorescent body instead of LED. Further, for providing an array of light emitting portions, only a single light emitting element can be used. In the latter case, a single backlight such as a fluorescent bulb is provided and optical shutters such as liquid crystal elements and PLZT switches (light emitting sections) are arrayed outside of the backlight.

Further, in the above-described embodiment, the LED head 41 includes LEDs arrayed in the longitudinal direction. In this case, a single array or a plurality of arrays can be provided.

Further, in the above-described embodiments, the cartridge frame 51, 151 is in the form of an outer casing constituting an entire profile of the process cartridge. However, a cartridge frame constituting a part of a profile of the process cartridge is also available.

Further, in the above-described embodiments, leaf springs 63R, 63L, 163 are employed as biasing member. However, instead of the leaf spring, other component having a prescribed resiliency or elasticity is also available, such as a rubber, a sponge, and a sponge covered with a film.

Further, in the first embodiment, the abutment surface 44 is flush with the rear surface 41A of the LED head 41. However, an abutment surface offset from the rear surface 41A is also available as long as the rear surface is forcibly engaged with the second positioning protrusion by the biasing force of the biasing member.

Further, the above-described embodiments pertain to color printers. However, the present invention is also applicable to a monochromatic printer, a color or monochromatic copying machine, and a color or monochromatic multi-function device.

While the invention has been described in detail and with reference to specific embodiments thereof, it would be apparent to those skilled in the art that various changes and modifications may be made without departing from the spirit and scope of the invention.

What is claimed is:

1. An image forming device comprising:

a photosensitive body;

an exposure unit having an exposure member elongated in a longitudinal direction and having light emitting sections arrayed in the longitudinal direction, the light emitting sections emitting light in an optical axis direction;

a frame supporting the photosensitive body;

a positioning protrusion protruding in the optical axis direction from one of the frame and the exposure unit, a remaining one of the frame and the exposure unit being formed with a positioning part engageable with the positioning protrusion; and, a biasing unit providing a biasing force that ensures engagement between the positioning protrusion and the positioning part, the biasing force urging the positioning part toward the positioning protrusion.

2. The image forming device as claimed in claim 1, wherein the frame has one lateral end portion and another lateral end portion positioned aligned with the one lateral end portion in the longitudinal direction; and wherein the positioning protrusion comprises a first protrusion protruding from the one lateral end portion, and a second protrusion protruding from the another lateral end portion; and wherein the exposure unit has one side surface directly confrontable with the first protrusion and the second protrusion; and wherein the positioning part comprises one of a recess, a groove and a through-hole formed at the one side surface and engageable with the first protrusion, and an engagement surface formed at the one side surface and engageable with the second protrusion.

3. The image forming device as claimed in claim 2, wherein each of the first protrusion and the second protrusion has a cylindrical surface, and wherein one of the recess, the groove and the through-hole has a V-shaped engagement surface engageable with the cylindrical surface of the first protrusion.

4. The image forming device as claimed in claim 2, wherein the biasing unit is provided at the frame.

5. The image forming device as claimed in claim 2, wherein the frame comprises:

an outer frame;

a support frame fixedly positioned inside the outer frame; and a cartridge frame accommodating therein the photosensitive body and detachably attached to the support frame for constituting a process cartridge, the biasing unit being provided at the cartridge frame.

6. The image forming device as claimed in claim 2, wherein the exposure unit has another side surface; and wherein the biasing unit is provided at the frame and engageable with the another side surface.

7. The image forming device as claimed in claim 6, wherein the biasing unit comprises a first biasing member positioned in alignment with the first protrusion in a direction connecting the one side surface and the another side surface; and a second biasing member positioned in alignment with the second protrusion in a direction connecting the one side surface and the another side surface.

8. The image forming device as claimed in claim 1, further comprising a top cover pivotally movable between an open position and a close position, the exposure unit being suspended from the top cover, in the open position the exposure unit being remote from the photosensitive body and in the close position the exposure unit being adjacent to the photosensitive body while the positioning protrusion is engaged with the positioning part.

9. The image forming device as claimed in claim 8, wherein the frame has one lateral end portion positioned and another lateral end portion positioned aligned with the one lateral end portion in the longitudinal direction; and wherein the positioning protrusion comprises a first protrusion protruding from the one lateral end portion, and a second protrusion protruding from the another lateral end portion; and wherein the exposure unit has one side surface directly confrontable with the first protrusion and the second protrusion; and wherein the positioning part comprises one of a recess, a groove and a through-hole formed at the one side surface and engageable with the first protrusion, and an engagement surface formed at the one side surface and engageable with the second protrusion.

10. The image forming device as claimed in claim 9, wherein each of the first protrusion and the second protrusion has a cylindrical surface, and wherein one of the recess, the groove and the through-hole has a V-shaped engagement surface engageable with the cylindrical surface of the first protrusion.

11. The image forming device as claimed in claim 9, wherein the biasing unit is provided at the frame.

12. The image forming device as claimed in claim 9, wherein the frame comprises:

an outer frame;

a support frame fixedly positioned inside the outer frame; and, a cartridge frame accommodating therein the photosensitive body and detachably attached to the support frame for constituting a process cartridge, the biasing unit being provided at the cartridge frame.

13. The image forming device as claimed in claim 9, wherein the exposure unit has another side surface; and wherein the biasing unit is provided at the frame and engageable with the another side surface.

14. The image forming device as claimed in claim 13, wherein the biasing unit comprises a first biasing member positioned in alignment with the first protrusion in a direction connecting the one side surface and the another side surface; and a second biasing member positioned in alignment with the second protrusion in a direction connecting the one side surface and the another side surface.

15. The image forming device as claimed in claim 1, wherein the frame has one lateral end portion and another lateral end portion aligned with the one lateral end portion in the longitudinal direction; and wherein the positioning protrusion comprises a first protrusion protruding from the one lateral end portion, and a guide protrusion protruding from the another lateral end portion; and wherein the exposure unit has a bottom surface directly confrontable with the first protrusion and the guide protrusion; and wherein the positioning part comprises a V-shaped engagement part formed at the bottom surface and engageable with the first protrusion, and an guide groove formed at the bottom surface and engageable with the guide protrusion.

16. The image forming device as claimed in claim 15, wherein the V-shaped engagement part is a part of one of a recess, a groove, and a through-hole.

* * * * *